US011369976B2

(12) United States Patent
Wiser, III et al.

(10) Patent No.: US 11,369,976 B2
(45) **Date of Patent: *Jun. 28, 2022**

(54) ELECTROSTATIC FILTER CORNER LATCH

(71) Applicant: Environmental Management Confederation, Inc., Rocky Hill, NJ (US)

(72) Inventors: Forwood C. Wiser, III, Kingston, NJ (US); John Augustus Lang, Jr., Yardley, PA (US)

(73) Assignee: Environmental Management Confederation, Inc., Princeton, NJ (US)

( * ) Notice: Subject to any disclaimer, the term of this patent is extended or adjusted under 35 U.S.C. 154(b) by 449 days.

This patent is subject to a terminal disclaimer.

(21) Appl. No.: 16/352,210

(22) Filed: Mar. 13, 2019

(65) Prior Publication Data

US 2019/0283040 A1 Sep. 19, 2019

Related U.S. Application Data

(60) Provisional application No. 62/642,012, filed on Mar. 13, 2018.

(51) Int. Cl.

| | |
|---|---|
| ***B03C 3/82*** | (2006.01) |
| ***B03C 3/155*** | (2006.01) |
| *B03C 3/41* | (2006.01) |

(52) U.S. Cl.

CPC ..... *B03C 3/82* (2013.01); *B03C 3/155* (2013.01); *B03C 3/41* (2013.01)

(58) Field of Classification Search

CPC combination set(s) only.

See application file for complete search history.

(56) References Cited

U.S. PATENT DOCUMENTS

| | | | | |
|---|---|---|---|---|
| 690,524 | A * | 1/1902 | Knight | A47J 31/06 210/477 |
| 3,209,074 | A | 9/1965 | French | |
| 4,549,887 | A | 10/1985 | Joannou | |
| 4,620,691 | A | 11/1986 | Waters, Jr. | |
| 4,628,386 | A | 12/1986 | Chabrolle | |
| 4,671,126 | A | 6/1987 | Sable | |
| 4,790,259 | A | 12/1988 | Morris et al. | |
| 4,908,634 | A | 3/1990 | Arimoto et al. | |
| 5,059,218 | A * | 10/1991 | Pick | E06B 9/52 96/66 |

(Continued)

OTHER PUBLICATIONS

International Search Report and Written Opinion of the International Searching Authority for PCT Application No. PCT/US2019/022014 dated Jun. 11, 2019.

(Continued)

*Primary Examiner* — Christopher P Jones
*Assistant Examiner* — Sonji Turner
(74) *Attorney, Agent, or Firm* — Schott, P. C.

(57) ABSTRACT

A filter assembly having two frames. The two frames are connected by a hinge about which they rotate. The two frames hold a filter media there between. The two frames are locked using one or more latches that are located along a side rail of the at least one of the two frames. The one or more latches are flushed with an edge of the side rails of the two frames, to couple the two frames in a closed position.

13 Claims, 5 Drawing Sheets

(56) References Cited

U.S. PATENT DOCUMENTS 5,108,470 A * 4/1992 Pick ..... B03C 3/155 96/58
5,184,706 A 2/1993 Christenson
5,603,476 A * 2/1997 Merk ..... B01D 46/0005 248/309.1
5,846,302 A * 12/1998 Putro ..... B03C 3/66 96/66
6,294,004 B1 * 9/2001 Summers ..... B03C 3/025 55/493
6,574,123 B2 6/2003 Wiser, III et al.
6,764,533 B2 * 7/2004 Lobiondo, Jr. ..... B03C 3/155 55/493
6,902,603 B2 * 6/2005 Wiser, III ..... B01D 46/0005 422/121
7,686,869 B2 3/2010 Wiser et al.
7,691,186 B2 4/2010 Wiser
7,708,813 B2 5/2010 Wiser et al.
8,070,861 B2 12/2011 Wiser et al.
8,252,095 B2 8/2012 Wiser et al.
8,252,097 B2 8/2012 Wiser
8,795,601 B2 8/2014 Wiser et al.
8,814,994 B2 8/2014 Wiser et al.
9,764,331 B2 9/2017 Wiser et al.
9,789,494 B2 10/2017 Wiser, III et al.
9,861,990 B2 * 1/2018 Wiser ..... B03C 3/09
10,058,809 B2 * 8/2018 Wiser, III ..... B01D 46/10
2009/0320426 A1 * 12/2009 Braunecker ..... B01D 46/0013 55/511
2014/0096494 A1 4/2014 Wiser, III et al.
2016/0303499 A1 10/2016 Wiser

OTHER PUBLICATIONS

International Preliminary Report ion Patentability dated Sep. 15, 2020, and Written Opinion of the International Searching Authority Completed on May 18, 2019 for the International Application No. PCT/US19/22014, 6 pages.

* cited by examiner

ELECTROSTATIC FILTER CORNER LATCH

TECHNICAL FIELD

The present disclosure relates generally to a latching mechanism for an air filter assembly. In particular, the present disclosure relates to securing multiple frames of the electrostatic air filter assembly together through the latching mechanism.

BACKGROUND

Indoor air includes small particles which, when inhaled, cause severe problems to human beings such as respiratory problems, allergies etc., and when just in the air, can damage machines and in particular, those with more sensitive electronics. In order to remove these particles, various types of air purifying devices or air filtration devices are used. One such air filtration device is an electrostatic air filtration device that uses electrostatic attraction to remove fine particulate matter such as dust and cigarette smoke from the air, such as may be seen in U.S. Pat. Nos. 3,209,074; 4,620,691; 4,628,386; 4,671,126; 4,790,259; 4,908,634; 5,184,706; 6,574,123; 7,686,869; 7,691,186; 7,708,813; 8,070,861; 8,252,095; 8,252,097; 8,795,601; 8,814,994; 9,764,331; 9,789,494; 9,861,990, and US Patent Application Publication 2016/0303499, the contents of which are incorporated by reference as if fully set forth herein. The electrostatic air filtration device may charge particles passing through the filter, which may encourage the particles to join with other charge particles, increasing their size, and making them easier to collect within a filter. To attract the charged particles, the electrostatic air filtration device comprises a collecting surface that may itself be charged, or it may be passive. After passing through the filter, air passing therethrough will contain fewer contaminants.

Conventionally, the electrostatic air filtration device may comprise filter media of filter material formed of a dielectric material. The filter media may be enclosed in frames and are locked/closed using latches that are pivotally attached to the frames. The latches extend around outer side edges of the frames. In a closed position, therefore, the latches extend beyond the edges of the frames and increase the width of the entire assembly. Because of this, the latches may catch during the installation and uninstallation of the filter assembly, causing damage not only to the frames, which are somewhat easier to fix or replace, but also frame housings, which are not. This damage can affect the filter's effectiveness as air may bypass damaged or misshapen filter elements, or it may even create damage to electrical connections and minimize or break them, rendering what was intended to be an electrostatic air filter, merely a passive one.

Thus, there exists a need for an improved latching mechanism for locking the frames of the electrostatic filter assembly.

SUMMARY

It is an object of the present disclosure to provide an efficient, robust, and easy way to handle electrostatic air filter by using an improved latching mechanism that locks the frames without extending beyond edges of the frames of the electrostatic air filter assembly.

According to an aspect of the present disclosure, there is provided a filter assembly that may comprise a first frame and a second frame. The first frame and the second frame are connected by a hinge about which they rotate and hold a filter media there between. The filter assembly includes at least one latch located along a side rail of at least one of the first frame and the second frame. The at least one latch is flush with an edge of the side rails of the first frame and the second frame to couple the first frame and the second frame in a closed position.

According to another aspect of the present disclosure, there is provided a filter assembly that may comprise a first frame and a second frame. The first frame and the second frame are connected by a hinge about which they rotate and hold a filter media there between. The filter assembly includes at least one latch located along a side rail of at least one of the first frame and the second frame. The at least one latch is flush with an edge of the side rails of the first frame and the second frame to couple the first frame and the second frame in a closed position. The at least one latch is located at one or more corners of the side rail.

The technology of the present disclosure is a mechanism to improve catching issues during the installation and uninstallation of the electrostatic air filter assembly and thus increase robustness and ease of handling of the electrostatic air filter assembly.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that may include the claimed disclosure, and explain various principles and advantages of those embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Hereinafter, the preferred embodiments of the present disclosure will be described in conjunction with the accompanying drawings. It should be understood that the preferred embodiments described herein are only used to illustrate and explain the present disclosure and are not intended to limit the present disclosure.

Figure 1A:
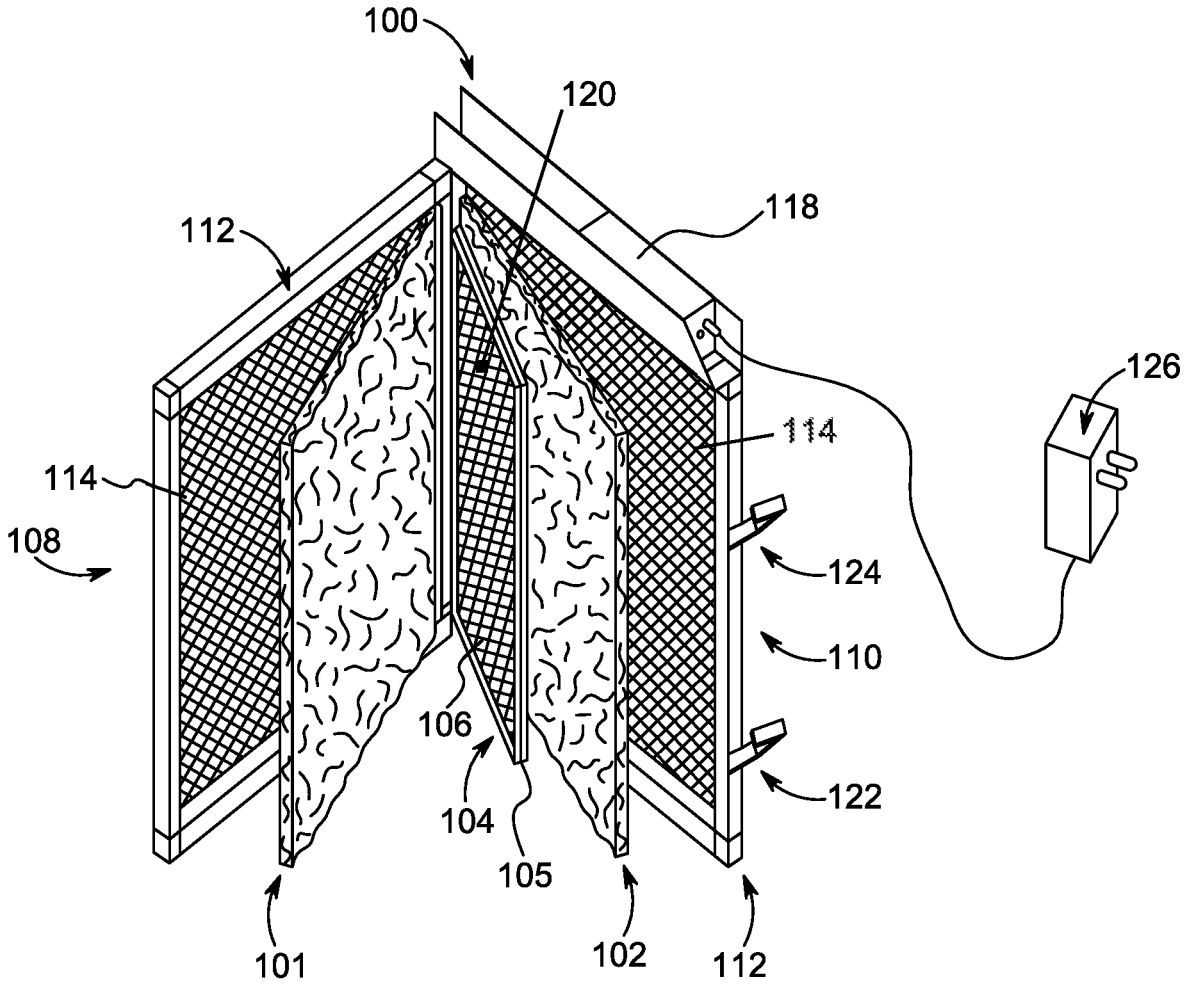
FIG. 1A (PRIOR ART)
FIG. 1A illustrates an example of a conventional electrostatic air filter assembly in an open position.

FIG. 1A illustrates a conventional electrostatic air filter assembly 100. The electrostatic air filter assembly 100 may include one or more sheets of filter material, i.e., filter media 101 and filter media 102. The electrostatic air filter assembly 100 may include a single sheet of filter material or may not be limited to two sheets of filter material. The filter media 101 and the filter media 102 may have similar characteristics, i.e., shape, size, material, etc. The shape of the filter media 101 and the filter media 102 may be rectangular. The filter media 101 and the filter media 102 may be made of a dielectric material, such as non-woven matting of polyester/wool blend. In an alternative embodiment, the shape of the filter media 101 and the filter media 102 may be, but is not limited to, square, circular, conical, etc.

The electrostatic air filter assembly 100 further may comprise a voltage supply 104 that may be located between the filter media 101 and the filter media 102. The voltage supply 104 may be located within a rectangular frame 105. The rectangular frame 105 may be smaller in size than the size of the filter media 101 and the filter media 102, such that the rectangular frame 105 may be easily clamped between the filter media 101 and the filter media 102. The rectangular frame 105 may be made of extruded aluminum onto which a charging screen 106 may be located. The charging screen 106 may be rectangular in shape. The charging screen 106 may have different structures, for example, a metal gauze, perforated metal sheet, a grill of wires, or a punched metal lattice.

The electrostatic air filter assembly 100 further may comprise two metal frames 112, which may be present to enclose the filter media 101, the filter media 102, and the rectangular frame 105. The two metal frames 112 may have similar characteristics, i.e., shape, size, material, etc. The two metal frames 112 may be larger in size than the size of the rectangular frame 105. The two metal frames 112 may be rectangular in shape. The two metal frames 112 act as housing or support to overall structure of the electrostatic air filter assembly 100. One of the two metal frames 112 acts as a first ground 108 for the electrostatic air filter assembly 100, and other of the two metal frames 112 may act as a second ground 110. The two metal frames 112 may be hinged at one edge such that the filter media 101, the filter media 102, and the rectangular frame 105 can be clamped between the two metal frames 112. The two metal frames 112 may surround one or more sides of rectangular wire meshes 114. The rectangular wire meshes 114 may be made of extruded aluminum. The rectangular wire meshes 114 may act as a support to the filter media 101 and the filter media 102. The filter media 101, the filter media 102, and the rectangular wire meshes 114 may be sized to ensure that the air sucked, inside the electrostatic air filter assembly 100, may pass through a first rectangular mesh of the rectangular wire meshes 114, through the filter media 101 and filter media 102, and further through a second rectangular mesh of the rectangular wire meshes 114.

The electrostatic air filter assembly 100 further may comprise an electrode 120 that may be placed above the filter media 102. The placement of the electrode 120 is such that the filter media 102 may fit between the electrode 120 and the rectangular wire meshes 114. A physical electrical contact is made between the electrode 120 and the charging screen 106, in order to charge particles of the air that entered the electrostatic air filtration assembly 100.

The electrostatic air filter assembly 100 further may comprise a high voltage power supply (not shown), which may be mounted in a channel 118 or be remote and run through wires in the channel. A transformer 126 may be used to supply power to the high voltage power supply. The high voltage power supply may provide a high voltage to electrode 120. The high voltage provided to the electrode 120 may charge the filter media 101 and filter media 102 of the electrostatic air filter assembly 100. The charging screen 106 may be provided to distribute charge to the filter media 101 and filter media 102.

The electrostatic air filter assembly 100 is closed and locked by the use of latches 122 and 124. The latches 122 and 124 are pivotably attached to one of the two metal frames 112. The latches 122 and 124 swing over the outside edges of both frames 112 to secure the resulting electrostatic air filtration assembly 100.

Figure 1B:
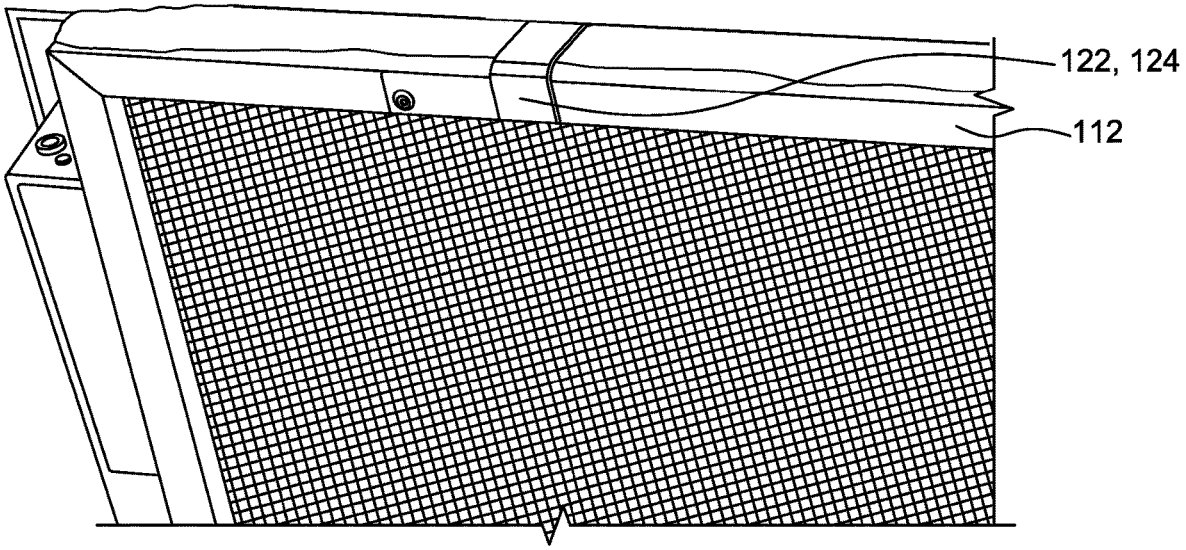
FIG. 1B (PRIOR ART)
FIG. 1B illustrates an example of a conventional electrostatic air filter assembly in a closed position.

FIG. 1B illustrates a conventional mechanism of locking of the electrostatic air filter assembly 100 using latches 122 and 124. In order to couple the two metal frames 112 of the electrostatic air filter assembly 100, the latches 122 and 124 extend beyond edges of the two metal frames 112. Due to the extension over the edges of the two metal frames 112, the width of the electrostatic air filter assembly 100 is increased. Further, there exist latch catching issues during the installation and uninstallation of the filter assembly. In order to overcome fit issues when there is inadequate space, the electrostatic air filter assembly 100 may be forced into an air handling unit. However, forcing the assembly into the air handling unit results in bending of the electrostatic air filter assembly 100, thereby damaging the electrostatic air filter assembly 100 or breaking electrical connections therein.

Figure 2A:
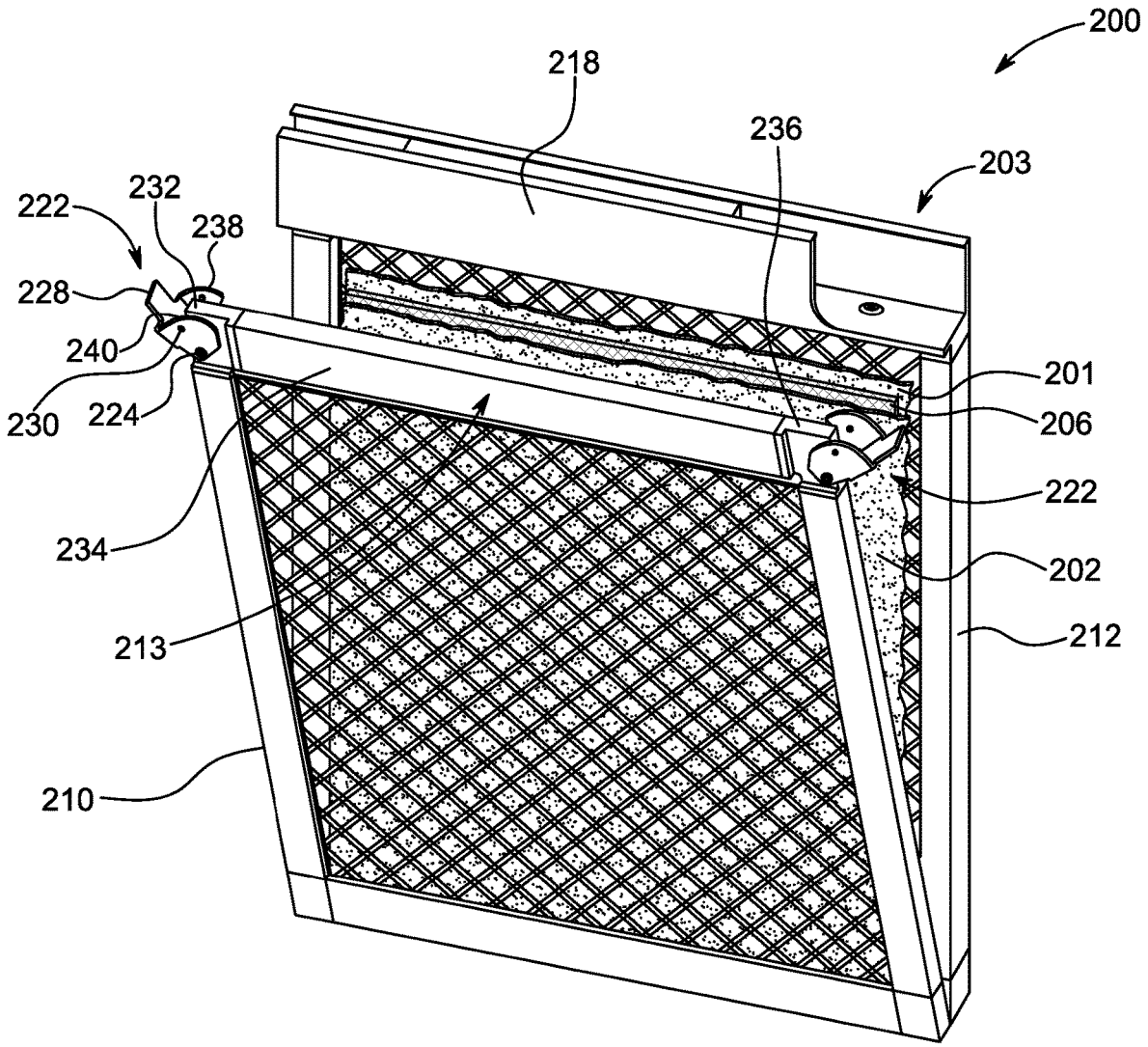
FIG. 2A illustrates an electrostatic air filter assembly in an open position.
Figure 2B:
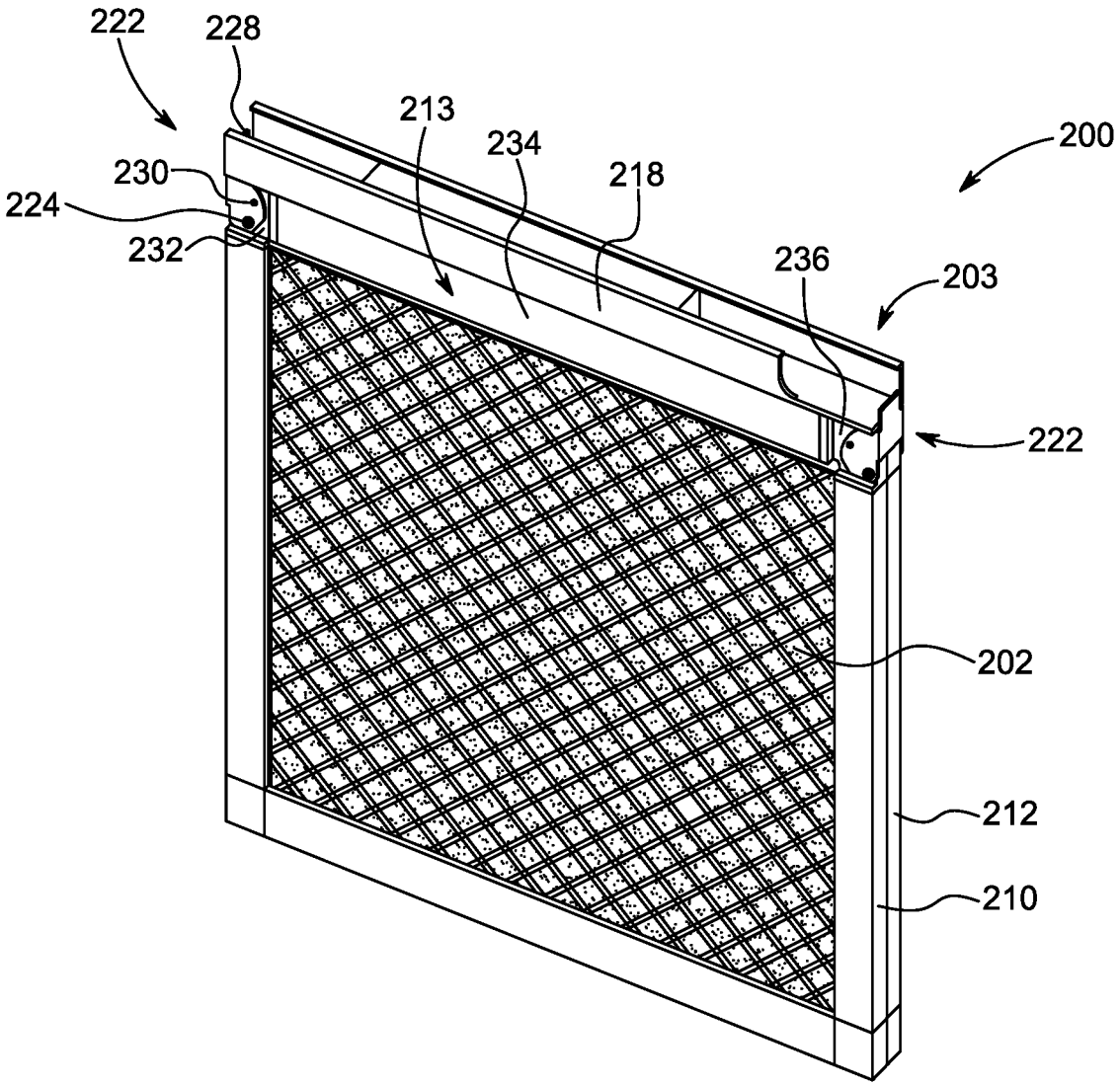
FIG. 2B illustrates an exemplary electrostatic air filter assembly in a closed position.

FIGS. 2A and 2B illustrate top front view of an electrostatic air filter assembly 200 in open and closed positions respectively. While the below description provides details related to FIGS. 2A and 2B, it may be apparent to a person skilled in the art that some parts visible in FIG. 2A may not be visible in FIG. 2B, and vice-versa due to open/closed position of the assembly 200. In the present embodiment, the electrostatic air filter assembly 200 may comprise a plurality of frames. The plurality of frames may be the outermost frames of the electrostatic air filter assembly 200. The plurality of frames of the electrostatic air filter assembly 200 may comprise a first frame 210 and a second frame 212. The first frame 210 and the second frame 212 may be hinged together at one end. The first frame 210 and the second frame 212 may enclose the two filter media 201, 202 between therein. The first frame 210 and the second frame 212 may enclose the charging screen 206. The first frame 210 and the second frame 212 may have similar characteristics, i.e., shape, size, material, etc. The first frame 210 and the second frame 212 may be, but is not limited to, rectangular, square, conical, circular etc. The first frame 210 and the second frame 212 may be larger in size than the size of the rectangular frame 105. In an alternative embodiment, the first frame 210 and the second frame 212 may be similar in size as the size of the rectangular frame 105. The first frame 210 and the second frame 212 may be larger in size than the size of the filter media 201 and the filter media 202. In an alternative embodiment, the first frame 210 and the second frame 212 may be similar in size as that of the size of the size of the filter media 201 and the filter media 202. The size of the first frame 210 and the second frame 212, filter media 201, and the filter media 202 may be similar to each other. In accordance with yet another alternative embodiment, the electrostatic air filter assembly 200 may be a single filter media assembly that may comprise a single filter media 202.

The electrostatic air filter assembly 200 may be closed and locked by the use of the latching mechanism that may include a plurality of latches 222. In another embodiment, the electrostatic air filter assembly 200 may include a single latch 222. FIGS. 2A and 2B illustrate partially open and closed positions, respectively, of the latches 222. In order to lock the electrostatic air filter assembly 200, the first frame 210 and the second frame 212 may be clamped and locked with the help of the latches 222. The first frame 210 and the second frame 212 may be hinged together at an end opposite to the end at which the latches 222 may be located. The first frame 210 and the second frame 212 may rotate about the hinge. The latches 222 may be secured to either the first frame 210 or the second frame 212. The latches 222, in the closed position, may engage the first frame 210 and the second frame 212. In an alternative embodiment, the latches 222 may be present on a combination of the first frame 210 or the second frame 212. For example, one or more latches 222 may be present on the first frame 210, while one or more other latches may be present on the second frame 212.

Each of the first frame 210 and the second frame 212 of the electrostatic air filter assembly 200 may comprise a side rail 213. In the present embodiment, the side rail 213 of a first frame 210 or a second frame 212 may comprise the latches 222. The latches 222 may be flush with an edge of the side rail 213 (as well as top rail or second portion 234) such that the latches 222, in the closed position, may be at a level similar to the edge of the side rail 213. Such an arrangement of the latches 222 being flush with the edge of the siderail 213, in the closed position, causes no increase in width of the assembly from the edge of the siderail 213. The flushing of the latches 222 may couple the first frame 210 and the second frame 212.

In the present embodiment, the side rail 213 may have a variable thickness. The side rail 213 may comprise a plurality of portions, i.e., a first portion 232, a second portion 234, and a third portion 236 along longitudinal direction of the side rail 213. The length of either the first portion 232 or the third portion 236 of the side rail 213 may be substantially equal to or at least slightly deeper than, the length of one of the latch tabs 238. The second portion 234 of the side rail 213 may be the remaining portion of the side rail 213, which is other than the first portion 232 and the third portion 236. The first portion 232 and/or the third portion 236 of the side rail 213 may have a first thickness that is less than a second thickness of the second portion 234 of the side rail 213. In order to attain the first thickness, an outer part of the side rail 213 is clipped from the first portion 232 and the third portion 236 of the side rail 213. Alternatively, the corners of the each frame 210, 212 may be molded pieces that engage the top and side rails 213, with male inserts inserted into hollow portions of each of the rails in a press=fit or adhesive engagement.

The latches 222 may be located at the first portion 232 and the third portion 236 of the side rail 213. The first portion 232 and/or the third portion 236 may be located at the corners of the side rail 213. Accordingly, the latches 222 may be located at the corners of the side rail 213. In an alternative embodiment, the latches 222 may be placed at the center or any other portion of the side rail 213, and the thickness of that portion may be varied accordingly.

The latches 222 may be located at the corners of the siderail 213 near a voltage input 203. The voltage input 203 may be provided through a channel 218. The channel 218 may be placed on one end of either of the first frame 210 or the second frame 212. The one end of either the first frame 210 or the second frame 212 may be opposite to the hinged end of the first frame 210 and the second frame 212. In an alternative embodiment, the latch 222 may be located at other portions that may be located away from the voltage input 203.

The latches 222 may be located at one or more corners/portions located on an edge of the first frame 210 and/or the second frame 212, which is different from the hinged edge of the first frame 210 and the second frame 212.

Figure 3A:
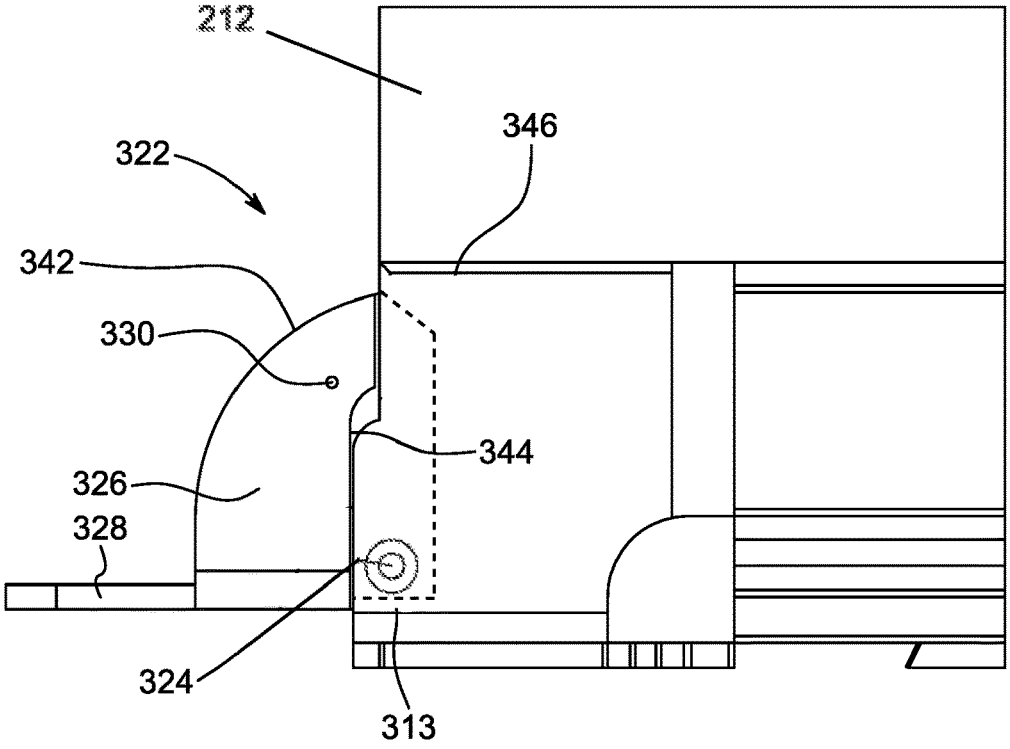
FIG. 3A illustrates a latching mechanism in an open position for the electrostatic air filter assembly.
Figure 3B:
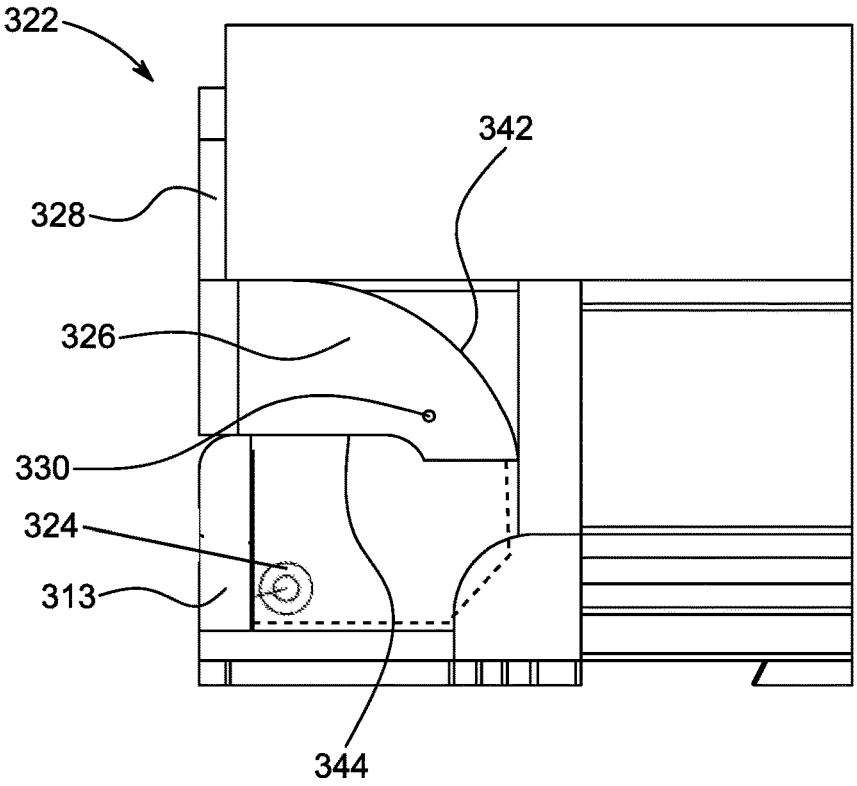
FIG. 3B illustrates a latching mechanism in a closed position for the electrostatic air filter assembly.

FIG. 3A illustrates an open position of the latch 322. The latch 322 located at the corner may be attached to either the first frame 210 or the second frame 212. The latch 322 may be secured to either the first frame 210 or the second frame 210, through a fastener 324. The fastener 324 may include, but is not limited to, a screw, bolt, rivet, etc. The latch 322 may rotate about an axis of the fastener 324. The rotation of the latch 322 may be between an open position (as illustrated in FIG. 3A) and the closed position (as illustrated in FIG. 3B). The rotation of the latch 322 between the closed position and the open position may couple the first frame 210 and the second frame 212 when the frames are closed to themselves.

The latch 322 may include tabs 326, 326*a* (tab 326*a* is shown in phantom as it is engaged to frame 210 and cannot be seen from the view shown) to engage the first frame 210 and the second frame 212.

FIG. 3A is described in conjunction with FIG. 2A which clearly illustrates two tabs 238 and 240. Accordingly, the tabs 326 may comprise a first tab 238 and a second tab 240. The first tab 238 may engage the first frame 210, while the second tab 240 may engage the second frame 212 to lock the first frame 210 and the second frame 212 together, thereby closing the electrostatic air filter assembly 200. The first tab 238 may engage the first frame 210 from an outer edge of the side rail 313 of the first frame 210. The second tab 240 may engage the second frame 212 from an outer edge of the side rail 313 of the second frame 212. The first tab 238 and the second tab 240 may comprise an outer part 342 and an inner part 344. The outer part 342 of each of the first tab 238 and the second tab 240 may have an arc shape. The inner part 344 of each of the first tab 238 and the second tab 240 may have a plurality of portions that may have different shapes as illustrated in FIGS. 3A and 3B. The first tab 238 and the second tab 240 may comprise a first end and a second end. The first end of each of the first tab 238 and the second tab 240 may connect to the side rail 313 of the respective first frame 210 and the second frame 212. The second end of each of the first tab 238 and the second tab 240 may be connected to a thumb tab 328 to open/close the latch 322. In an exemplary embodiment, the thumb tab 328 may be an extension of the second end of the tabs 326. The thumb tab 328 may be connected to both the first tab 238 and the second tab 240 of the tabs 326, at one end of the thumb tab 328. The thumb tab 328 may have a thickness that is equivalent to the difference of the second thickness and the first thickness so that when the latch 322 is in the closed position, the thumb tab may be closed at a level similar to the edge of the side rail 313.

The first tab 238 and the second tab 240 may have different characteristics, i.e., size, shape, material, etc. The first tab 238 and the second tab 240 may be arc shaped. The first tab 238 may have a first arc length and the second tab 240 may have a second arc length. The first tab 238 and the second tab 240 may move in synchronization with each other, using the thumb tab 328. The first tab 238 and the second tab 240 may move in clockwise direction to switch from the closed position to the open position, and may move in counter clockwise direction to switch from the open position to the closed position. A person skilled in the art may understand that the first tab 238 and the second tab 240 may move in clockwise direction to switch from the open position to the closed position and may move in counter clockwise direction to switch from the closed position to the open position. According to an alternative embodiment, the first tab 238 and the second tab 240 may have similar characteristics, i.e., size, shape, material etc.

FIG. 3B illustrates the closed position of the latch 322. In the closed position of the latch 322, the first frame 210 may be engaged with the first tab 238 and the second frame 212 may be engaged with the second tab 240. The engagement of the first tab 238 and the second tab 240 is such that the latch 322 may be held in the closed position. The latch 322 may be held in the closed position with a help of a punch 330 on the tab and a mating detent 331 on the frame 210. The punch 330 is comprised in each of the first tab 238 and the second tab 240. The punch 330 may be located on a surface, of each of the first tab 238 and the second tab 240, away from the thumb tab 328. The first tab 238 may comprise a first punch, and the second tab 240 may comprise a second punch. In the closed position of the latch 322, the first punch engages the first tab 238 and the second punch engages the second tab 240. The present embodiment is not limited to only one punch in each of the first tab 238 and the second tab 240, and there may be more than one punch in each of the first tab 238 and the second tab 240.

The tabs 326 may move in a hollow space of the side rail 313 of the first frame 210 and the second frame 212. The punch 330 comprised in the tabs 326 engages with the side rail 313. Either of the first tab 238 or the second tab 240 may comprise a punch.

The positioning of the latch 322 is such that it avoids any kind of catching issues during the installation and uninstallation of the latch 322, as there is no separate mechanism to extend the assembly's width involved in the electrostatic air filter assembly 200 to create such issues. The latch 322, in the closed position, is flush with the side rails 313. The flushing of the latch 322 may comprise levelling of the latch 322 with the side rail 313 such that the thumb tab 328 may be at a similar level with the side rail 313, in the closed position of the latch 322. Hence, no separate assembly for catching of the latch 322 is required. The positioning of the latch 322, when in closed position, is such that the total width of the electrostatic air filter assembly 200 is reduced as compared to the electrostatic air filter assembly, as shown in FIG. 1.

The present latching mechanism may be implemented to any assembly, to lock structures/surfaces together within the assembly. The assembly may be, but is not limited to, appliances, automobile, household items etc. The assembly may comprise of one or more structures. The one or more structures may include a first structure and a second structure. The first structure and the second structure may be of any shape, size, and material etc. The first structure and the second structure may be connected by a hinge. The first structure and the second structure may rotate about the hinge.

The first structure and the second structure may be locked together with the help of at least one latch. The at least one latch may be located along an edge of at least one of the first structure and the second structure. The at least one latch is flush with the edge to couple the first structure and the second structure. The flushing of the at least one latch may couple the first structure and the second structure. The at least one latch in the closed position, is flushed with the edge, hence no separate assembly for catching of the at least one latch is required. The positioning of the at least one latch when in closed position, is such that the total width of the assembly is reduced. Further, use of the latch may not results in latch catching issues during the installation and uninstallation of the assembly.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure may be defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "may comprise," "comprising," "has", "having," "includes", "including," "contains", "containing" or any other variation thereof, are intended to cover a non-exclusive inclusion, such that a process, method, or article that may comprise, has, includes, contains a list of elements does not include only those elements but may include other elements not expressly listed or inherent to such process, method, or article. An element proceeded by "may comprise . . . a", "has . . . a", "includes . . . a", "contains . . . a" does not, without more constraints, preclude the existence of additional identical elements in the process, method, or article that may comprise, has, includes, contains the element. The terms "a" and "an" are defined as one or more unless explicitly stated otherwise herein. The terms "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The invention claimed is:

1. A filter assembly comprising:

a first frame and a second frame, wherein the first frame and the second frame are connected by a hinge about which the first frame and the second frame rotate, and wherein the first frame and the second frame hold a filter media there between; and at least one latch located along a side rail of at least one of the first frame and the second frame, wherein the at least one latch is flush with an edge of the side rails of the first frame and the second frame to couple the first frame and the second frame in a closed position;

wherein the side rail has a variable thickness, wherein the side rail has a first portion that has a first thickness less than a second thickness at a second portion of the side rail, wherein the at least one latch is located at the first portion of the side rail within the first thickness, and wherein the first portion is a corner of the side rail.

2. The filter assembly of claim 1, wherein the at least one latch is located at one or more corners of the side rail.

3. The filter assembly of claim 1, wherein the at least one latch is secured to one of the first frame and the second frame.

4. The filter assembly of claim 3, wherein the at least one latch is secured to the side rail through a fastener.

5. The filter assembly of claim 4, wherein the at least one latch rotates about an axis of the fastener between an open position and a closed position to couple the first frame and the second frame.

6. The filter assembly of claim 1, wherein the at least one latch further comprises a first tab and a second tab, wherein the first tab engages the first frame and the second tab engages the second frame.

7. The filter assembly of claim 6, wherein the first tab and the second tab comprises a punch that engages the first tab and the second tab to the first frame and the second frame, respectively.

8. The filter assembly of claim 6, wherein the at least one latch further comprises a thumb tab to access the at least one latch, and wherein the thumb tab is connected to both the first tab and the second tab, at one end of the thumb tab.

9. The filter assembly of claim 1, wherein the at least one latch is located near a power supply of the filter assembly.

10. A filter assembly comprising:

a first frame and a second frame, wherein the first frame and the second frame are connected by a hinge about which the first frame and the second frame rotate and wherein the first frame and the second frame hold a filter media there between; and at least one latch located along a side rail of at least one of the first frame and the second frame, wherein the at least one latch is flush with an edge of the side rail to couple the first frame and the second frame, and wherein the at least one latch is located at one or more corners of the side rail;

wherein the side rail has a variable thickness, wherein the side rail has a first portion that has a first thickness less than a second thickness at a second portion of the side rail, wherein the at least one latch is located at the first portion of the side rail within the first thickness, and wherein the first portion is a corner of the side rail.

11. The filter assembly of claim 10, wherein the one or more corners are located at the first part of the side rail.

12. The filter assembly of claim 10, wherein the at least one latch is secured to the side rail through a fastener.

13. The filter assembly of claim 12, wherein the at least one latch rotates about an axis of the fastener between an open position and a closed position to couple the first frame and the second frame.

* * * * *